US011189241B2

(12) United States Patent
Gao

(10) Patent No.: US 11,189,241 B2
(45) Date of Patent: Nov. 30, 2021

(54) METHOD FOR CHARGING PIXELS AND DISPLAY PANEL

(71) Applicant: TCL CHINA STAR OPTOELECTRONICS TECHNOLOGY CO., LTD., Shenzhen (CN)

(72) Inventor: Xiang Gao, Guangdong (CN)

(73) Assignee: TCL CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/769,401

(22) PCT Filed: Apr. 10, 2020

(86) PCT No.: PCT/CN2020/084169

§ 371 (c)(1),
(2) Date: Jun. 3, 2020

(87) PCT Pub. No.: WO2021/189548

PCT Pub. Date: Sep. 30, 2021

(65) Prior Publication Data

US 2021/0304698 A1 Sep. 30, 2021

(30) Foreign Application Priority Data

Mar. 27, 2020 (CN) ..... 202010230949.6

(51) Int. Cl.
*G09G 3/36* (2006.01)

(52) U.S. Cl.
CPC ..... *G09G 3/3688* (2013.01); *G09G 3/3614* (2013.01); *G09G 2300/0426* (2013.01); *G09G 2310/08* (2013.01)

(58) Field of Classification Search
USPC ..... 345/87–89, 96, 100, 204, 211–212
See application file for complete search history.

(56) References Cited

U.S. PATENT DOCUMENTS

| | | | | |
|---|---|---|---|---|
| 6,266,039 | B1 * | 7/2001 | Aoki | G09G 3/3611 345/94 |
| 2003/0146890 | A1 * | 8/2003 | Sasaki | G09G 3/3659 345/87 |
| 2007/0164957 | A1 * | 7/2007 | Hsieh | G09G 3/3655 345/90 |

(Continued)

FOREIGN PATENT DOCUMENTS

| | | |
|---|---|---|
| CN | 101676985 A | 3/2010 |
| CN | 106297689 A | 1/2017 |

(Continued)

*Primary Examiner* — Tony O Davis
(74) *Attorney, Agent, or Firm* — The Roy Gross Law Firm, LLC; Roy Gross

(57) ABSTRACT

A method for charging pixels and a display panel is provided, the method comprising: turning on thin-film transistor switches of pixels in a current row; inputting a positive polarity signal to one of a first data line and a second data line; inputting a negative polarity signal to the other of the first data line and the second data line at set intervals; turning off the thin-film transistor switches of the pixels in the current row.

10 Claims, 3 Drawing Sheets

(56) References Cited

U.S. PATENT DOCUMENTS

2009/0009454 A1* 1/2009 Urisu ..... G09G 3/2096 345/87
2009/0262059 A1* 10/2009 Chung ..... G09G 3/3648 345/96
2010/0128028 A1* 5/2010 Lee ..... G09G 3/3677 345/214
2013/0300722 A1 11/2013 Gyouten
2014/0218347 A1* 8/2014 Lee ..... G09G 3/3614 345/211
2014/0306871 A1* 10/2014 Lu ..... G09G 3/3677 345/96
2014/0354619 A1* 12/2014 Jang ..... G09G 3/3696 345/212
2015/0325197 A1* 11/2015 Hong ..... G09G 3/3688 345/205
2015/0348483 A1* 12/2015 Du ..... G09G 3/3614 345/209
2016/0062201 A1* 3/2016 Lim ..... H01L 27/124 257/773
2016/0293123 A1* 10/2016 Feng ..... G09G 3/3614
2016/0379579 A1* 12/2016 Cho ..... G09G 3/3275 345/214
2017/0154588 A1* 6/2017 Du ..... G09G 3/3677
2018/0114497 A1* 4/2018 Tan ..... G09G 3/3651
2018/0182324 A1* 6/2018 Lin ..... G09G 3/3614
2018/0182327 A1* 6/2018 Huang ..... G09G 3/3614
2018/0218694 A1* 8/2018 Zuo ..... G09G 3/3648
2018/0261169 A1* 9/2018 Du ..... G09G 3/3614
2018/0286331 A1* 10/2018 Lu ..... G09G 3/3614
2018/0322842 A1* 11/2018 Hao ..... G09G 3/3677
2019/0189068 A1* 6/2019 Zhou ..... G09G 3/3614
2019/0237034 A1* 8/2019 Hao ..... G09G 3/3648
2019/0251918 A1* 8/2019 Wang ..... G09G 3/3688
2021/0011350 A1* 1/2021 Wu ..... G09G 3/3614

FOREIGN PATENT DOCUMENTS

CN 108182915 A 6/2018
CN 109192168 A 1/2019

* cited by examiner

METHOD FOR CHARGING PIXELS AND DISPLAY PANEL

CROSS REFERENCE TO RELATED APPLICATION

This application claims priority to International Application No. PCT/CN 2020/084169, filed on 2020 Apr. 10, which claims priority to Chinese Application No. 202010230949.6, filed on 2020 Mar. 27. The entire disclosures of each of the above applications are incorporated herein by reference.

Background of the Disclosure

Field of Disclosure

The present disclosure relates to the field of display technology, and particularly relates to a method for charging pixels and a display panel.

Description of Related Art

In existing liquid crystal display panels, a positive polarity charging time equals to a negative polarity charging time. As shown in FIG. 1, a positive polarity signal P and a negative polarity signal N are simultaneously transmitted to data lines. Due to a long falling time for a gate signal Gate, there is insufficient time for the positive polarity signal P to charge pixels with V+, and may cause wrong charging when the negative polarity signal N charges the pixels with V−, leading to a technical problem of poor overall charging rates.

SUMMARY OF THE INVENTION

The present disclosure provides a method for charging pixels and a display panel, which solve a technical problem of a low overall charging rate due to insufficient charging time of a positive electrode and wrong charging of a negative electrode in the existing display panel.

An embodiment of the present disclosure provides a method for charging pixels of a display panel, the display panel comprising a pixel array including at least two pixels, a first data line, and a second data line, both electrically connected to the pixel array, the method comprising:

turning on thin-film transistor switches of the pixels in a current row;

inputting a positive polarity signal to one of the first data line and the second data line;

inputting a negative polarity signal to the other of the first data line and the second data line at set intervals; and turning off the thin-film transistor switches of the pixels in the current row;

wherein, before the step of turning on the thin-film transistor switches of the pixels in a current row, the method further comprises:

acquiring a time difference between an off time of the thin film transistor switches corresponding to the data line that is input the positive polarity signal and an off time of the thin film transistor switches corresponding to the data line that is input the negative polarity signal; and wherein a length of the set interval equals to the time difference and ranges between 0.5 microseconds and 1 microsecond.

In the method for charging pixels described in the embodiment of the present disclosure, before the step of turning on the thin-film transistor switches of the pixels in the current row, the method further comprises:

determining a polarity of a voltage signal to be input to each of the first data line and the second data line, according to an (n)th picture frame, layout of the pixels in the display panel, or a polarity inversion of each pixel in an (n−1)th picture frame, where n is a positive integer.

In the method for charging pixels described in the embodiment of the present disclosure, the step of turning off the thin-film transistor switches of the pixels in the current row comprises:

pausing or stopping a gate signal being sent to the pixels in the current row;

delaying the turning off of the thin film transistor switches corresponding to the data line that is input the positive polarity signal by a first interval; and delaying the turning off of the thin film transistor switches corresponding to the data line that is input the negative polarity signal by a second interval, where the second interval is greater than the first interval.

In the method for charging pixels described in the embodiment of the present disclosure, the thin film transistor switch is a P-type transistor switch or an N-type transistor switch.

Another embodiment of the present disclosure provides a method for charging pixels of a display panel, the display panel comprising a pixel array including at least two pixels, a first data line, and a second data line, both electrically connected to the pixel array, the method comprising:

turning on thin-film transistor switches of the pixels in a current row;

inputting a positive polarity signal to one of the first data line and the second data line;

inputting a negative polarity signal to the other of the first data line and the second data line at set intervals; and turning off the thin-film transistor switches of the pixels in the current row.

In the method for charging pixels described in the embodiment of the present disclosure, before the step of turning on the thin-film transistor switches of the pixels in the current row, the method further comprises:

acquiring a time difference between an off time of the thin film transistor switches corresponding to the data line input the positive polarity signal and an off time of the thin film transistor switches corresponding to the data line input the negative polarity signal.

In the method for charging pixels described in the embodiment of the present disclosure, a length of the set interval equals to the time difference and ranges between 0.5 microseconds and 1 microsecond.

In the method for charging pixels described in the embodiment of the present disclosure, before the step of turning on the thin-film transistor switches of the pixels in the current row, the method further comprises:

determining a polarity of a voltage signal to be input to each of the first data line and the second data line, according to an (n)th picture frame, layout of the pixels in the display panel, or a polarity inversion of each pixel in an (n−1)th picture frame, where n is a positive integer.

In the method for charging pixels described in the embodiment of the present disclosure, the step of turning off the thin-film transistor switches of the pixels in the current row comprises:

pausing or stopping a gate signal being sent to the pixels in the current row;

delaying the turning off of the thin film transistor switches corresponding to the data line that is input the positive polarity signal by a first interval; and delaying the turning off of the thin film transistor switches corresponding to the data line that is input the negative polarity signal by a second interval, where the second interval is greater than the first interval.

Another embodiment of the present disclosure provides a display panel, which comprises a pixel array including at least two pixels, a first data line, and a second data line, both electrically connected to the pixel array, comprising:

a gate driving circuit unit, configured to turn on and off thin film transistor switches of the pixels in a current row;

a first charging module, configured to input a positive polarity signal to one of the first data line and the second data line in one picture frame; and a second charging module, configured to input a negative polarity signal to the other of the first data line and the second data line at set intervals in the picture frame.

In the display panel described in the embodiment of the present disclosure, the display panel comprises a preset module which is configured to store and set the set interval; a length of the set interval equals to a time difference between an off time of the thin film transistor switches corresponding to the data line that is input the positive polarity signal and an off time of the thin film transistor switches corresponding to the data line that is input the negative polarity signal.

In the display panel described in the embodiment of the present disclosure, the length of the set interval ranges between 0.5 microseconds and 1 microsecond.

In the display panel described in the embodiment of the present disclosure, the display panel further comprises a determination module, configured to determine a polarity of a voltage signal to be input to each of the first data line and the second data line, according to an (n)th picture frame, layout of the pixels in the display panel, or a polarity inversion of each pixel in an (n−1)th picture frame, where n is a positive integer.

In the display panel described in the embodiment of the present disclosure, a driving mode of the display panel display is one of a row inversion, a column inversion, a pixel inversion or a half-frame inversion.

The beneficial effect of this invention is: in the method for charging pixels and the display panel of the present disclosure, a positive polarity signal is first input to a part of the data lines, then a negative polarity signal is input to the other data lines after a set interval, so as to change the phases of both the positive polarity signal and the negative polarity signal (that is the phase of the positive polarity signal is at the front, the phase of the negative polarity signal is at the back), which further increases a charging time of a positive electrode, improves a charging rate of a negative electrode, reduces charging time of a positive electrode, and avoids wrong charging, thereby improving a charging rate of the entire display panel.

BRIEF DESCRIPTION OF DRAWINGS

In order to more clearly illustrate embodiments of the present disclosure or related art, following drawings will be described in the embodiments are briefly introduced. It is obvious that the drawings are merely some embodiments of the present disclosure, those of ordinary skill in this field can obtain other drawings according to these drawings without paying any creative labor.

DETAILED DESCRIPTION OF EMBODIMENTS

Figure 1:
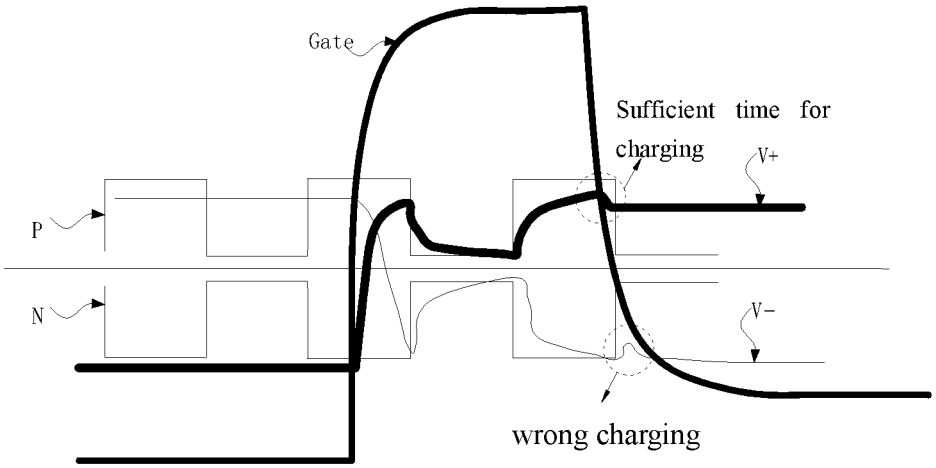
FIG. 1 is a schematic diagram of charging pixels of an existing display panel.

Embodiments of the present disclosure are described clearly and completely in conjunction with the drawings. Obviously, the described embodiments are only a part of the embodiments of the present disclosure, but not all the embodiments. Based on the embodiments of the present disclosure, all other embodiments obtained by skilled persons in the art without making any creative work belong to the protection scope of the present application.

In the description of the present disclosure, it should be understood that terms such as "center", "longitudinal", "cross", "length", "width", "thickness", "up", "down", "front", "back", "left", "right", "vertical", "horizontal", "top", "bottom", "inside", "outside", "clockwise", "counter-clockwise" etc, indicate orientations or positional relationship according to the orientations or the positional relationship shown in the drawings, and are only intended to facilitate and simplify the description of this present disclosure, rather than indicating or implying that devices or components referred to must have a specific orientation, be constructed and operated in a specific orientation, which therefore cannot be understood as the limitation to the present disclosure. In addition, terms "first" and "second" are only used for description, and cannot be understood as indicating or implying relative importance, or implicitly indicating the number of technical features indicated. Thus, features defined as "first" and "second" may explicitly or implicitly include one or more of the features. In the description of the present disclosure, the meaning of "multiple" is two or more, unless there is other specifically limitation.

In the description of the present disclosure, it should be noted that, unless there is other clearly specification and limitation, the terms "installation", "link" and "connection" should be understood in a broad sense. For example, they can mean fixed connection, detachable connection, or integrally connection; they can mean mechanical connection, electrical connection, or to communicate with each other; they can mean direct connection, indirect connection through an intermediary, connection between two components or interaction relationship between two components. For those persons of ordinary skill in the art, the specific meanings of the above terms in the present disclosure can be understood according to specific circumstances.

In the present disclosure, unless there is other clearly specification and limitation, a first feature "above" or "below" a second feature may mean that the first feature and second feature are in direct contact, or the first feature and second feature are in indirect contact through another feature between them. Moreover, the first feature is "above", "on the top of" and "upon" the second feature may mean that the first feature is directly above or obliquely above the second feature, or only simply means that a horizontal height of the first feature is higher than a horizontal height of the second feature. The first feature is "below", "on the bottom of" and "under" the second feature may mean that the first feature is directly below or obliquely below the second feature, or simply means that the horizontal height of the first feature is lower than the horizontal height of the second feature.

The following disclosure provides many different embodiments or examples for implementing different structures of the present application. In order to simplify the disclosure of the present application, components and installation in specific embodiments are described below. Of course, they are only used as examples, rather than as limitation to the present application. In addition, the present application may repeat reference numbers and/or reference letters in different examples for the purpose of simplification and clarity, and the repetition itself does not indicate the relationship between the various embodiments and/or settings discussed. In addition, the present application provides examples of various specific processes and materials, but those persons of ordinary skill in the art may use other processes and/or materials.

Figure 2:
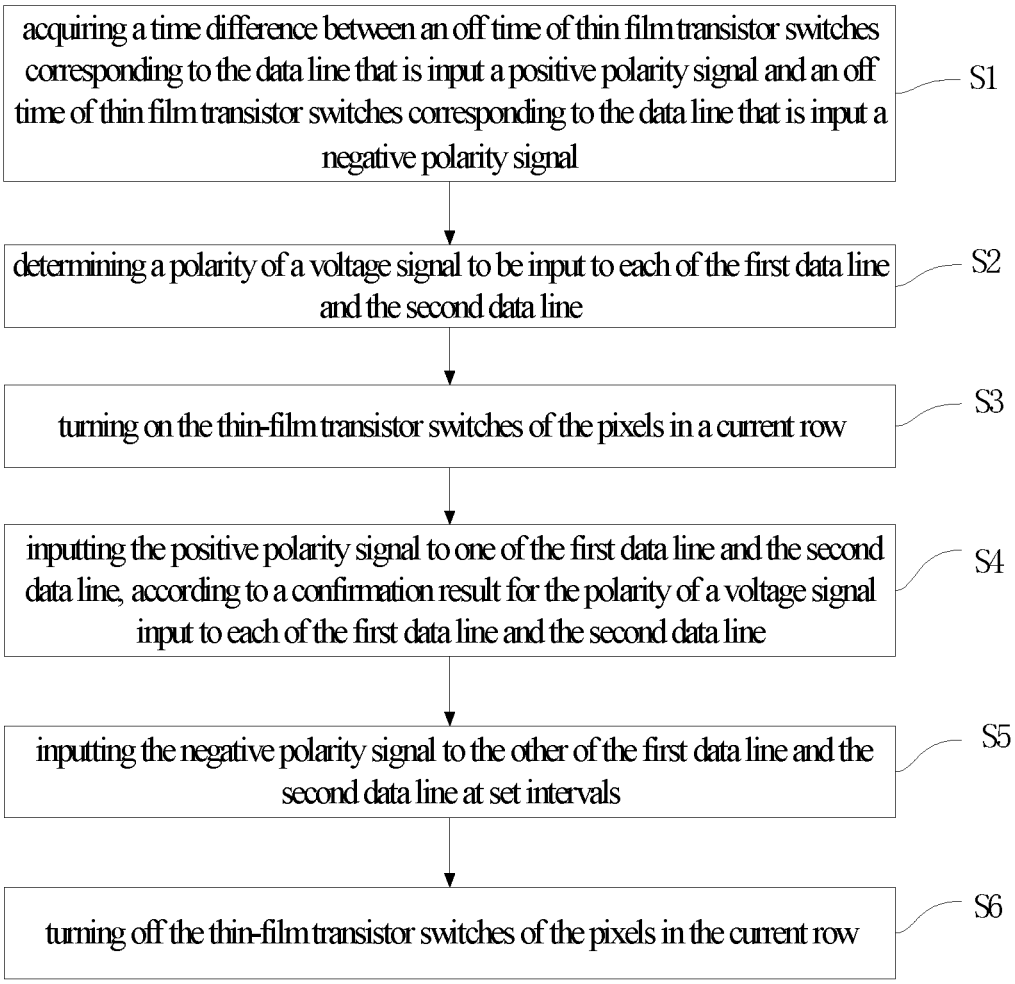
FIG. 2 is a schematic flowchart of a method for charging pixels provided by an embodiment of the present disclosure.

Referring to FIG. 2, a schematic diagram of a method for charging pixels of an existing display panel is provided.

An embodiment of the present application provides a method for charging pixels of a display panel, where the display panel is a liquid crystal display panel.

The display panel comprising a pixel array and data lines electrically connected to the pixel array. The pixel array includes at least two pixels. The data lines include a first data line and a second data line.

The method for charging pixels of a display panel in the present application comprises:

Step S1: acquiring a time difference between an off time of thin film transistor switches corresponding to the data line that is input a positive polarity signal and an off time of thin film transistor switches corresponding to the data line that is input a negative polarity signal.

Step S2: determining a polarity of a voltage signal to be input to each of the first data line and the second data line.

Step S3: turning on the thin-film transistor switches of the pixels in a current row.

Step S4: inputting the positive polarity signal to one of the first data line and the second data line, according to a confirmation result for the polarity of a voltage signal input to each of the first data line and the second data line.

Step S5: inputting the negative polarity signal to the other of the first data line and the second data line at set intervals.

Step S6: turning off the thin-film transistor switches of the pixels in the current row.

In the method for charging pixels of the present application, a positive polarity signal is first input to a part of the data lines, then a negative polarity signal is input to the other data lines after a set interval, so as to change the phases of both the positive polarity signal and the negative polarity signal (that is the phase of the positive polarity signal is at the front, the phase of the negative polarity signal is at the back), which further increases a charging time of a positive electrode, improves a charging rate of a negative electrode, reduces charging time of a positive electrode, and avoids wrong charging, thereby improving a charging rate of the entire display panel.

The method for charging pixels of the present application is described below.

In the step S1 of acquiring a time difference between an off time of thin film transistor switches corresponding to the data line that is input the positive polarity signal and an off time of thin film transistor switches corresponding to the data line that is input the negative polarity signal, specifically, the pixel includes a thin film transistor switch and a pixel electrode electrically connected to the thin film transistor switch. The thin film transistor switch is a P-type transistor switch or an N-type transistor switch.

During a trial run of the display panel, a gate signal of the pixels in the current row is turned off to turn off the thin film transistor switches of the pixels in the current row, wherein, when the gate signal is weaker than the voltage signal of the corresponding data line, the thin film transistor switch is considered to be off.

However, in the process for turning off the thin film transistor switch, even if input the same gate signal, the thin film transistor switch corresponding to the positive polarity is turned off earlier than the thin film transistor switch corresponding to the negative polarity, due to a long falling time for the gate signal, high voltage of the positive polarity, and low voltage of the negative polarity. Thus, though the positive polarity signal and the negative polarity signal are simultaneously input to the corresponding data lines, the time for the positive polarity to charge is shorter than the time for the negative polarity to charge.

Also, because the thin film transistor switch corresponding to the positive polarity is turned off earlier than the thin film transistor switch corresponding to the negative polarity, there is a time difference between their turn-off times, and the step S1 is to obtain the time difference. Optionally, the time difference may be an average value or a median value between time differences obtained when the thin film transistor switches are turned off in the current row at several times, or may be another value.

Optionally, the time difference ranges between 0.5 microseconds (inclusive of 0.5 microseconds) and 1 microsecond (inclusive of 1 microsecond). In the present application, the time difference may be 0.6 microseconds, 0.7 microseconds, 0.8 microseconds, or 0.9 microseconds.

Then move to the step S2 of determining the polarity of the voltage signal to be input to each of the first data line and the second data line.

Specifically, determine the polarity and value of the voltage signal to be input to each of the first data line and the second data line, according to at least one of an (n)th picture frame, layout of the pixels in the display panel, and a polarity inversion of each pixel in an (n−1)th picture frame, where the n is a positive integer. Optionally, a driving mode of the display panel display is one of a row inversion, a column inversion, a pixel inversion, a half-frame inversion, or a frame inversion.

That is, in a same picture frame of the whole display panel, if the polarity of the voltage signal input to the first data line is positive, then the voltage signal input to the second data line is negative; if the polarity of the voltage signal input to the first data line is negative, then the voltage signal input to the second data line is positive, wherein, the step S1 and S2 are in no particular order.

Then move to the step S3 of turning on the thin-film transistor switches of the pixels in the current row.

Specifically, the display panel may include a display substrate, multiple rows of scanning lines, multiple columns of data lines, and multiple rows and columns of pixels, all arranged on the display substrate. It should be understood that each pixel is electrically connected to a row of the scanning lines and a column of the data lines, so that when a gate signal (Gate) is input to a row of the scanning lines to turn on the thin film transistor switches, and a voltage signal is input to a column of the data lines, the voltage signal may be input to the pixels both connected to the row of the scanning lines and the column of the data lines. Optionally, a gate of the thin film transistor of each pixel is electrically connected to one scanning line, and a source or a drain of the thin film transistor of each pixel is electrically connected to one data line.

Then move to the step S4 of inputting the positive polarity signal to one of the first data line and second data line, according to the confirmation result for the polarity of a voltage signal input to each of the first data line and the second data line.

For example, the positive polarity signal is input to the first data line when the thin film transistor switches in the current row are turned on, if the confirmation result is to input the positive polarity signal to the first data line in an (i)th picture frame, where i is a positive integer.

Then move to the step S5 of inputting the negative polarity signal to the other of the first data line and second data line at set intervals.

Specifically, based on the example of the step S4, the negative polarity signal is input to the second data line after the set interval if a confirmation result is to input the negative polarity signal to the second data line.

Optionally, the length of the set interval equals to the time difference, that is, the length of the set interval also ranges between 0.5 microseconds (0.5 microseconds inclusive) and 1 microsecond (1 microsecond inclusive), too. In the present application, the length of the set interval may also be 0.6 microseconds, 0.7 microseconds, 0.8 microseconds or 0.9 microseconds.

Figure 4:
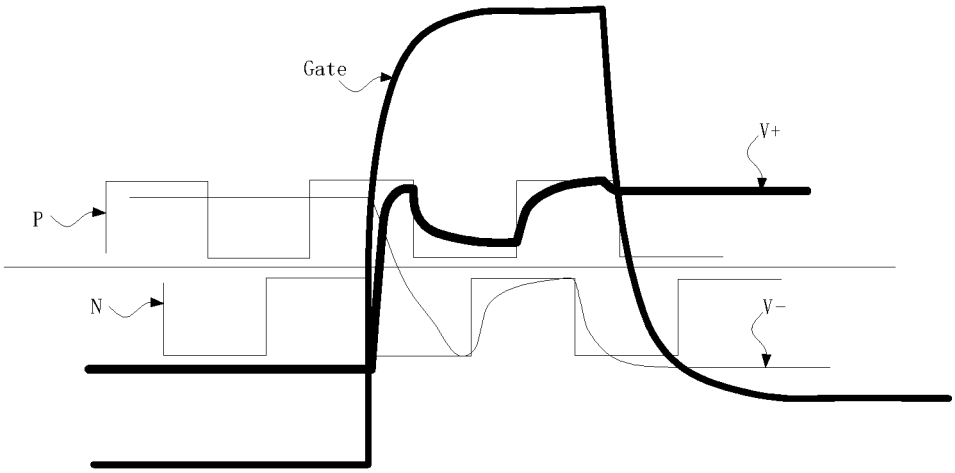
FIG. 4 is a schematic diagram for charging of the display panel provided by the embodiment of the present disclosure.

Referring to FIG. 4, in the method for charging pixels of the present application, turning on and off the thin film transistor switch is controlled via the gate signal (Gate), the positive polarity signal is input to the corresponding data line before the set interval, than the negative polarity signal is input so as to change the phases of both the positive polarity signal P and the negative polarity signal N (that is the phase of the positive polarity signal is at the front, the phase of the negative polarity signal is at the back), which further increases charging time of a positive electrode, improves a charging rate of a negative electrode, reduces charging time of a positive electrode, and avoid wrong charging, thereby improving a charging rate of the entire display panel.

In addition, the length of the set interval does not necessarily equal to the time difference to change the phases of both the positive polarity signal and the negative polarity signal, but may also be less or greater than the time difference, as long as the phase of the positive polarity signal and the phase of the negative polarity signal compensate each other.

Then move to the step S6 of turning off the thin-film transistor switches of the pixels in the current row.

Specifically, the step S6 comprises:

A first step, pausing or stopping a gate signal being sent to the pixels in the current row.

A second step, delaying a first interval to turn off the thin film transistor switches corresponding to the data line that is input the positive polarity signal.

A third step, delaying a second interval to turn off the thin film transistor switches corresponding to the data line that is input the negative polarity signal, where the second interval is greater than the first interval.

In the first step, pausing or stopping a gate signal sent to the pixels in the current row means to turn off the gate signal of the scanning line in the current row.

In the second step and third step, due to the long time for falling edge of the gate signal, high voltage of the positive polarity, and low voltage of the negative polarity, the thin film transistor switches corresponding to the positive polarity are turned off earlier than the thin film transistor switches corresponding to the negative polarity, even though the same gate signal is input.

In this way, a process for charging the pixels in the current row of the display panel in the present application is completed. Specifically, a process for charging the display panel in the embodiment is described as follows: when the process for charging the pixels in a first row is completed, a gate driving circuit turns off the thin film transistor switches of pixels in the first row under the control of a driving IC. Then, the thin film transistor switches of pixels in a second row are turned on to charge the pixels in the second row, and when the charging is completed, the thin film transistor switches of the pixels in the second row are turned off. Then, the thin film transistor switches of the pixels are turned on row by row, and a data signal is sequentially input to the pixels to charge whose thin film transistor switches have been turned on in the current row. Finally, the charging of the pixels on the entire display panel is completed, that is, the display of a picture frame is completed.

Figure 3:
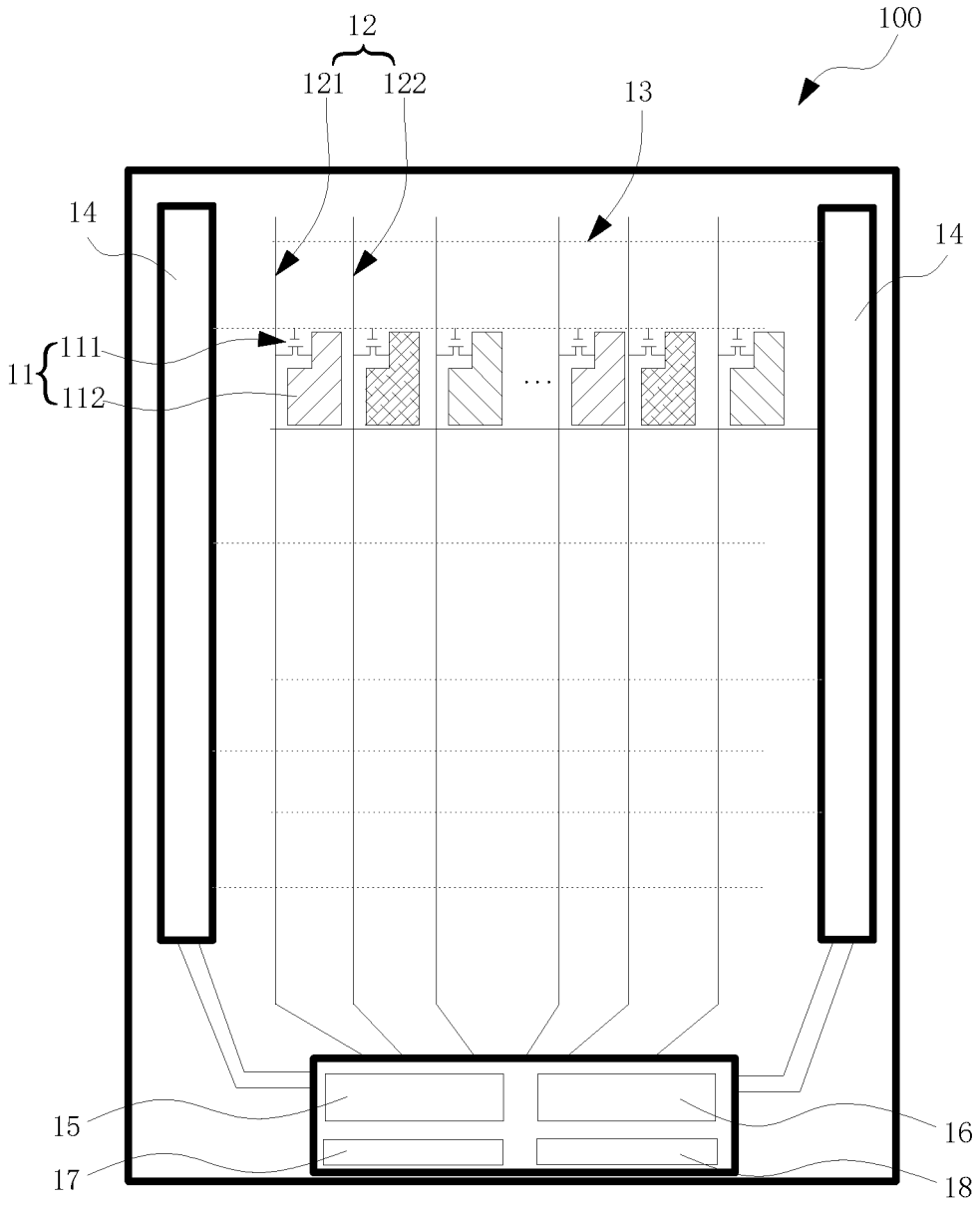
FIG. 3 is a schematic structural diagram of a display panel provided by the embodiment of the present disclosure

Referring to FIG. 3, an embodiment of the present application further relates to a display panel 100, which includes a pixel array, data lines 12 electrically connected to the pixel array, and scan lines 13 electrically connected to the pixel array. The pixel array includes at least two pixels 11.

The data lines 12 include a first data line 121 and a second data line 122. The pixel 11 include a thin film transistor switch 111 and a pixel electrode 112 electrically connected to the thin film transistor switch 111. Specifically, a gate of the thin film transistor switch 111 is electrically connected to one scan line 13, a source of the thin film transistor switch 111 is electrically connected to one data line 12, the source or a drain of the thin film transistor switch 111 is electrically connected to the pixel electrode 112.

The display panel 100 further includes a gate driving circuit unit 14, a first charging module 15 and a second charging module 16.

The gate driving circuit unit 14 is configured to turn on and off the thin film transistor switches 111 of the pixels 11 in a current row, and is electrically connected to the pixels 11 via the scanning lines 13.

The first charging module 15 is configured to input a positive polarity signal to one of the first data line 121 and second data line 122 in one picture frame. The second charging module 16 is configured to input a negative polarity signal to the other of the first data line 121 and the second data line 122 at set intervals in the picture frame. Each of the first charging module 15 and second charging module 16 is electrically connected to the pixels 11 via the corresponding data lines 12.

Optionally, the first charging module 15 and the second charging module 16 are both integrated in a same data driving chip, or the first charging module 15 and the second charging module 16 are integrated in different data driving chips.

It can be understood that when a gate signal (Gate) is input to the scanning lines 13 in one row to turn on the thin film transistor switches 111, a voltage signal is input to the data lines 12 in one column, the voltage signal may be input to the pixels 11 electrically connected to the scanning lines 13 in the row and the data lines 12 in the column to charge. Based on the mechanism for charging the pixels in the current row, a process for charging the display panel 100 includes: when a process for charging the pixels 11 in a first row is completed, the gate driving circuit unit 14 turns off the thin film transistor switches 111 of the pixels 11 in the first row under the control of a driving IC. Then, the thin film transistor switches 111 of the pixels 11 in a second row are turned on to charge the pixels 11 in the second row, and when the charging is completed, the thin film transistor switches 111 of the pixels 11 in the second row are turned off. Then, the thin film transistor switches 111 of the pixels 11 are turned on row by row, and a data signal is sequentially input to the pixels 11 whose thin film transistor switches 111 have been turned on in the current row to charge. Finally, the charging of the pixels 11 on the entire display panel 100 is completed, that is, the display of a picture frame is completed.

Referring to FIG. 4, in a same picture frame of the display panel 100 of the present application, the first charging module 15 inputs a positive polarity signal to one of the first data line 121 and the second data line 122 at first, then after a set interval, the second charging module 16 inputs a negative polarity signal to the other of the first data line 121 and the second data line 122, so as to change the phases of both the positive polarity signal and the negative polarity signal (that is the phase of the positive polarity signal is at the front, the phase of the negative polarity signal is at the back), which further increases time for charging a positive electrode, improves a charging rate of a negative electrode, reduces time for charging a negative electrode, and avoids wrong charging, thereby improving a charging rate of the entire display panel 100.

In the display panel 100 of the present application, the display panel 100 comprises a preset module 17 which is configured to store and set the set interval. The length of the set interval equals to a time difference between an off time of the thin film transistor switches 111 corresponding to the data line 12 that is input the positive polarity signal and an off time of the thin film transistor switches 111 corresponding to the data line 12 that is input the negative polarity signal.

The preset module 17 is electrically connected to the first charging module 15 and the second charging module 16. When the first charging module 15 outputs a positive polarity signal, the second charging module 16 will output a negative polarity signal after the set interval stored in the preset module 17. When the second charging module 16 outputs a positive polarity signal, the first charging module will output a negative polarity signal after the set interval stored in the preset module 17.

The specific process for acquiring the time difference may refer to the step S1 in the method of charging pixels in the above embodiments, and the details are not described herein again.

Optionally, the length of the set interval ranges between 0.5 microseconds (inclusive of 0.5 microseconds) and 1 microsecond (inclusive of 1 microsecond), and may be 0.6 microseconds, 0.7 microseconds, 0.8 microseconds or 0.9 microseconds.

In addition, the length of the set interval does not necessarily equal to the time difference to change the phases of both the positive polarity signal and the negative polarity signal, but may also be lesser or greater than the time difference, as long as the phase of the positive polarity signal and the phase of the negative polarity signal compensate each other. However, when the length of the set interval equals to the time difference, not only the charging rate of the positive polarity is improved, but also the wrong charging of the negative polarity is avoided to the maximum extent within a prescribed charging time.

The display panel 100 in the present application further comprises a determination module 18, which is configured to determine a polarity of a voltage signal to be input to each of the first data line and the second data line, according to an (n)th picture frame, layout of the pixels in the display panel, or a polarity inversion of each pixel in an (n−1)th picture frame, where n is a positive integer.

The determination module 18 is electrically connected to the first charging module 15 and the second charging module 16. The first charging module 15 and the second charging module 16 input corresponding polarity signals to corresponding data lines 12 according to a result determined by the determining module 18.

That is, if the polarity of the voltage signal input to the first data line 121 is positive, then the voltage signal input to the second data line 122 is negative; if the polarity of the voltage signal input to the second data line 121 is negative, then the voltage signal input to the second data line 122 is positive.

Optionally, a driving mode of the display panel display is one of a row inversion, a column inversion, a pixel inversion, a half-frame inversion or a frame inversion.

In the display panel 100 of this embodiment, the column inversion is used as an example for the driving mode of the display panel 100, but not limited to this. The first charging module 15 inputs the positive voltage signal to the first data lines 121 in odd columns, the second charging module 16 inputs the negative polarity voltage signal to the second data lines 122 in even columns, and when the charging is completed, the column inversion is performed. Then, the first charging module 15 inputs a negative polarity voltage signal to the first data lines 121 in the odd columns, and the second charging module 16 inputs a positive polarity voltage signal to the second data lines 122 in the even columns, when the charging is completed, the column inversion is performed, and the process is repeated.

The process for charging the pixels in the display panel 100 is the same as or similar to the method for charging pixels of the above embodiments, which can refer to the description of the method for charging pixels for details and is not described herein again.

In the method for charging pixels and the display panel of the present application, a positive polarity signal is first input to a part of the data lines, then a negative polarity signal is input to the other data lines after a set interval, so as to change the phases of both the positive polarity signal and the negative polarity signal (that is the phase of the positive polarity signal is at the front, the phase of the negative polarity signal is at the back), which increases the charging time of a positive electrode, improves the charging rate of the negative electrode, reduces the charging time of the negative electrode, and avoids wrong charging, thereby improving the charging rate of the entire display panel.

The display panel and the method for charging pixels provided by the embodiments of the present application are illustrated in detail above. Specific embodiments are used to explain the principles and implementation of the present application. The descriptions of the above embodiments are only used to help understand the technical scheme and its core idea of this application. Persons of ordinary skill in the art should understand that they can still modify the technical solutions described in the above embodiments, or equivalently replace some technical features of the technical solutions. Moreover, these modifications or replacements should be considered to belong to the protection scope of the present disclosure.

What is claimed is:

1. A method for charging pixels of a display panel, wherein the display panel comprises a plurality of rows of scan lines and a plurality of columns of first data lines and second data lines, the first data lines and the second data lines are disposed alternately, any two adjacent first and second data lines and any two adjacent scan lines define a pixel, the pixels in any two adjacent rows are separated by only one of the scan lines, the pixels in any two adjacent columns are separated by only one of the first data lines or one of the second data lines, each pixel is provided with only one thin film transistor switch, and the method comprises:

turning on thin-film transistor switches of the pixels in a current row;

inputting a positive polarity signal to the first data lines in a picture frame;

inputting a negative polarity signal to the second data lines at a set interval in the same picture frame, so that a phase of the positive polarity signal and a phase of the negative polarity signal compensate each other in the same picture frame; and turning off the thin-film transistor switches of the pixels arranged in the current row, which comprises:

pausing or stopping a gate signal being sent to the pixels in the current row;

delaying the turning off of the thin film transistor switches corresponding to the first data lines that are input the positive polarity signal by a first interval; and delaying the turning off of the thin film transistor switches corresponding to the second data lines that are input the negative polarity signal by a second interval, wherein the second interval is greater than the first interval, and the set interval equals to a first time difference between the first interval and the second interval.

2. The method of claim 1, wherein, before the step of turning on the thin-film transistor switches of the pixels in the current row, the method further comprises:

determining a polarity of a voltage signal to be input to each of the first data lines and the second data lines according to an (n)th picture frame, layout of the pixels in the display panel, or a polarity inversion of each pixel in an (n−1)th picture frame, where n is a positive integer.

3. The method of claim 1, wherein the thin film transistor switches are P-type transistor switches or N-type transistor switches.

4. The method of claim 1, wherein, before the step of turning on the thin-film transistor switches of the pixels in the current row, the method further comprises:

acquiring a second time difference between an off time of the thin film transistor switches corresponding to the first data lines that are input the positive polarity signal and an off time of the thin film transistor switches corresponding to the second data lines that are input the negative polarity signal in the same picture frame, wherein the set interval equals to the second time difference.

5. The method of claim 4, wherein the second time difference ranges between 0.5 microseconds and 1 microsecond.

6. A display panel, comprising:

a plurality of rows of scan lines;

a plurality of columns of first data lines and second data lines that are disposed alternately, wherein any two adjacent first and second data lines and any two adjacent scan lines define a pixel, the pixels in any two adjacent rows are separated by only one of the scan lines, the pixels in any two adjacent columns are separated by only one of the first data lines or one of the second data lines;

a plurality of thin film transistor switches, wherein each pixel is provided with only one of the thin film transistor switches;

a gate driving circuit unit configured to turn on and off the thin film transistor switches of the pixels in a current row;

a first charging module configured to input a positive polarity signal to the first data lines in a picture frame;

a second charging module configured to input a negative polarity signal to the second data lines at a set interval in the same picture frame, so that a phase of the positive polarity signal and a phase of the negative polarity signal compensate each other in the same picture frame; and a preset module configured to store and set the set interval, wherein the set interval equals to a time difference between an off time of the thin film transistor switches corresponding to the data lines that are input the positive polarity signal and an off time of the thin film transistor switches corresponding to the data lines that are input the negative polarity signal in the same picture frame.

7. The display panel of claim 6, wherein the set interval ranges between 0.5 microseconds and 1 microsecond.

8. The display panel of claim 6, further comprising:

a determination module configured to determine a polarity of a voltage signal to be input to each of the first data lines and the second data lines, according to an (n)th picture frame, layout of the pixels in the display panel, or a polarity inversion of each pixel in an (n−1)th picture frame, where n is a positive integer.

9. The display panel of claim 6, wherein the display panel display is driven by a driving mode of a row inversion, a column inversion, a pixel inversion, or a half-frame inversion.

10. The display panel of claim 6, wherein the gate driving circuit unit is configured to turn off the thin film transistor switches of the pixels in a current row by pausing or stopping sending a gate signal to the pixels in the current row;

when the gate driving circuit unit pauses or stops sending a gate signal to the pixels in the current row, the thin film transistor switches corresponding to the first data lines are turned off after a first interval, and the thin film transistor switches corresponding to the second data lines are turned off after a second interval; and the second interval is greater than the first interval, and the set interval equals to a time difference between the first interval and the second interval.

* * * * *